United States Patent [19]

Knauthe

[11] 4,370,193

[45] Jan. 25, 1983

[54] INSERTION OF ACCURATELY POSITIONED CORE TUBES IN WINDING MACHINES

[75] Inventor: Joachim Knauthe, Hochdahl, Fed. Rep. of Germany

[73] Assignee: Jagenberg Werke AG, Dusseldorf, Fed. Rep. of Germany

[21] Appl. No.: 213,241

[22] Filed: Dec. 4, 1980

[30] Foreign Application Priority Data

Dec. 5, 1979 [DE] Fed. Rep. of Germany ..... 2948877

[51] Int. Cl.[3] ..... B65C 3/12

[52] U.S. Cl. ..... 156/446; 156/187; 156/457; 156/458; 242/56 R; 242/66

[58] Field of Search ..... 156/446, 187, 184, 458, 156/457; 242/56 R, 67.1, 65, 66

[56] References Cited

U.S. PATENT DOCUMENTS

| | | | |
|---|---|---|---|
| 3,345,010 | 10/1967 | Egan | 242/66 |
| 3,505,150 | 4/1970 | Andersson | 156/457 X |
| 3,918,654 | 11/1975 | Okubo et al. | 242/66 X |
| 4,153,493 | 5/1979 | Hollander et al. | 156/188 |

FOREIGN PATENT DOCUMENTS 2709684 9/1977 Fed. Rep. of Germany .

*Primary Examiner*—David A. Simmons

*Attorney, Agent, or Firm*—Sprung, Horn, Kramer & Woods

[57] ABSTRACT

A process for insertion of an accurately positioned second core tube provided along a generatrix with means for adhering the head end of a web into the wedge formed by two rotatable support rolls of a winding machine, and for ejection of a first tube supported by said support rolls and wound with said web comprising ejecting the first wound tube from the wedge to a position where it no longer contacts both support rolls, while ejecting the first tube displacing a second tube carrying means for adhesion to the web to a position adjacent said wedge, severing the web when the first tube reaches inoperative position, and discharging the second tube into the wedge so as to be rotated by the support rolls, the adhesion means on the second tube causing it to adhere the severed web thereto for winding on the rotating second roll. An apparatus is provided therefor with the ejecting means advantageously in the form of a bar having a forward angled end and operatively associated with clamp jaws which hold the second tube and release it at the appropriate stage.

1 Claim, 4 Drawing Figures

INSERTION OF ACCURATELY POSITIONED CORE TUBES IN WINDING MACHINES

BACKGROUND OF THE INVENTION

The present invention relates to an apparatus for insertion of an accurately positioned core tube provided along a generatrix with adhesive means such as adhesive tape, daubs of glue, etc., for adhering the head end of a web, into the wedge formed by two rotatable support rolls of a winding machine, and for ejection of the web roll.

An apparatus for ejection of the web roll, insertion of a core tube and affixing of the head end of a web to the core tube is disclosed in German patent application DOS No. 27 09 684. One drawback of that prior-art apparatus is that it does not permit the core tube to be introduced accurately positioned into the wedge formed between the support rolls since the core tube rolls into said wedge over one of the support rolls, which makes it impossible to position the core tube in the wedge as desired. In this prior-art apparatus, there is no need to insert the core tube accurately positioned since the head end of the web is attached to the core tube with the aid of a stapling means that permits the head end of the web to be fastened to the core tube at any desired point on its circumference. However, attaching the head end of the web to the core tube requires a special and rather costly stapling means. The latter can be dispensed with when an adhesive means such as adhesive tape, daubs of glue, etc., is provided along a generatrix of the core tube to cause the head end of the web to adhere to the core tube. Now a core tube thus provided with adhesive means must be introduced into the wedge between the support rolls in a specific position, with the adhesive means directed upwardly or downwardly, if the head end of the web is to adhere properly and without wrinkling. As pointed out above, this is not possible with the prior-art apparatus.

Moreover, with the prior-art apparatus two separate apparatus components are required to insert the core tube and to eject the web roll.

SUMMARY OF THE INVENTION

The invention has as its object to provide an apparatus of the type initially mentioned which is simple in construction and in operation and makes it possible to accelerate the replacement of web roll and core tube. Reduction of the lost production time due to web-roll and core-tube changes is of considerable practical importance.

In accordance with the invention, this object is accomplished in that an apparatus of said type is provided with a clamping means which is displaceable in an arcuate path and which has secured to it, on the side facing the web roll, a bar ejecting the web roll, clamping means and ejector bar thus being combined to form a structural unit. During the web-roll and core-tube change, this structural unit can be displaced by a single drive, and the core tube gripped by the clamping means can then be introduced accurately positioned into the wedge between the support rolls of the winding machine at the same time that the web roll is being ejected by the ejector bar. Thus web-roll ejection and core-tube insertion occur simultaneously, with the result that the downtime which has been unavoidable with the apparatuses known up to now is greatly reduced. Moreover, the apparatus in accordance with the invention is of simple construction, and since it works with just one drive it is also more reliable in operation than prior-art apparatuses that require two separate drives.

In accordance with an advantageous embodiment of the apparatus of the invention, the clamping means may be displaceable and actuable by driving means. Moreover, the forward end of the ejector bar is preferably bent or angled inwardly to provide guidance for the severed end of the web, and the cutting-blade arrangement may be such that the front edge of the ejector bar is able to serve as abutment surface for the blade.

BRIEF DESCRIPTION OF THE DRAWINGS

The invention will now be described in greater detail with reference to the accompanying drawings, which illustrates an embodiment of the invention and wherein.

DETAILED DESCRIPTION OF THE INVENTION

Figure 1:
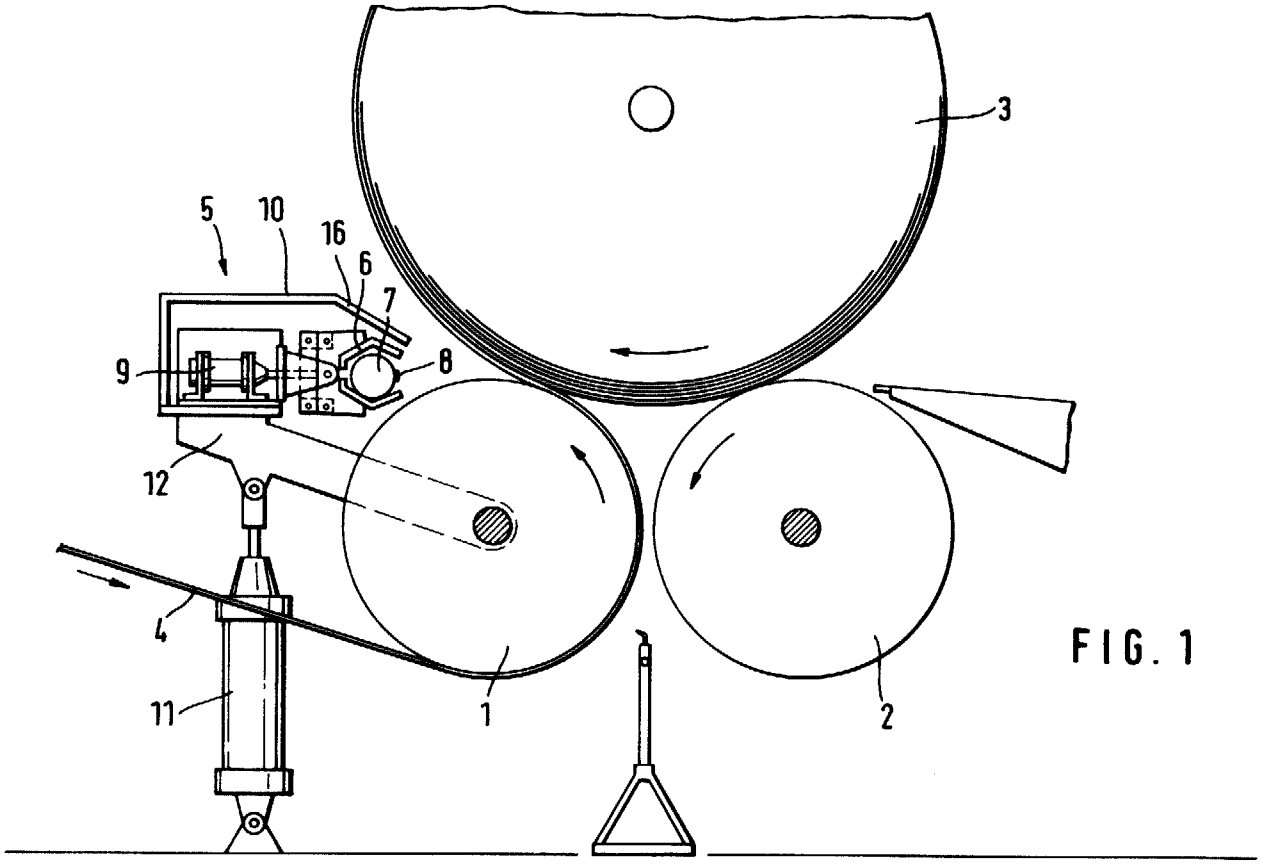
FIGS. 1 to 4 are diagrammatic representations of the various phases of the web-roll and core-tube change.

As shown in FIG. 1, the winding machine basically consists of two support rolls 1 and 2 which are driven in rotation and on which a web roll 3 is being wound with a web 4 without the use of a shaft. The direction of rotation of the support rolls 1 and 2 and of the web roll 3 is indicated by arrows. A web-roll ejecting and core-tube inserting apparatus in accordance with the invention, generally designated 5, is in the waiting position, with a core tube 7 held accurately positioned in a clamping means 6. The adhesive tape affixed along a generatrix of the core tube 7 is designated 8. A drive 9, which may be a pneumatic or hydraulic drive, for example, is provided for actuation of the clamping means 6. Disposed on the side of the clamping means 6 which faces the web roll 3 is an ejector bar 10, which forms a structural unit with the clamping means 6.

By means of a drive 11, the web-roll ejecting and core-tube inserting apparatus 5 can be displaced over an arcuate path with the aid of a lever 12, for example.

Figure 2:
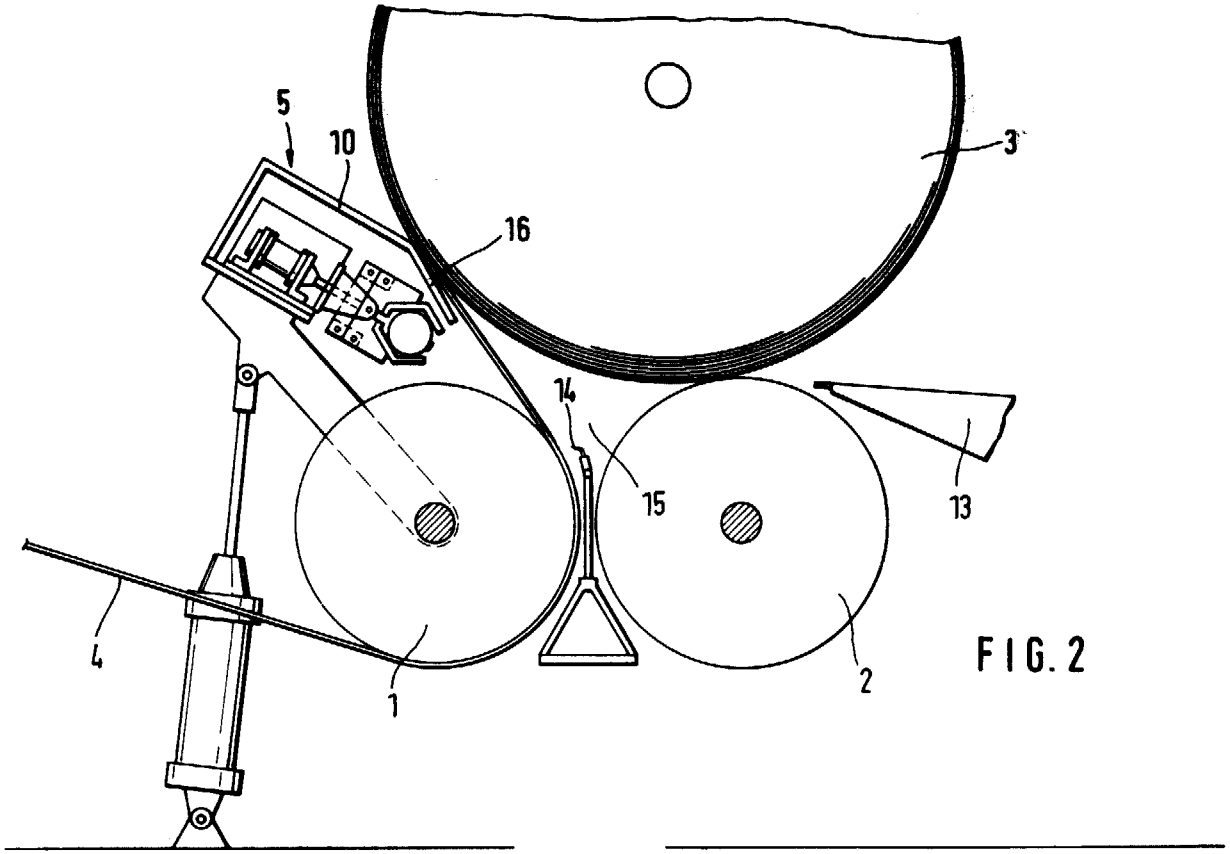

FIG. 2 shows the position of the web-roll ejecting and core-tube insertingonto a roll-off table 13. A cutting blade 14 which serves to sever the web 4 has been raised through the gap between the support rolls 1 and 2 into the wedge 15 between the support rolls 1 and 2.

Figure 3:
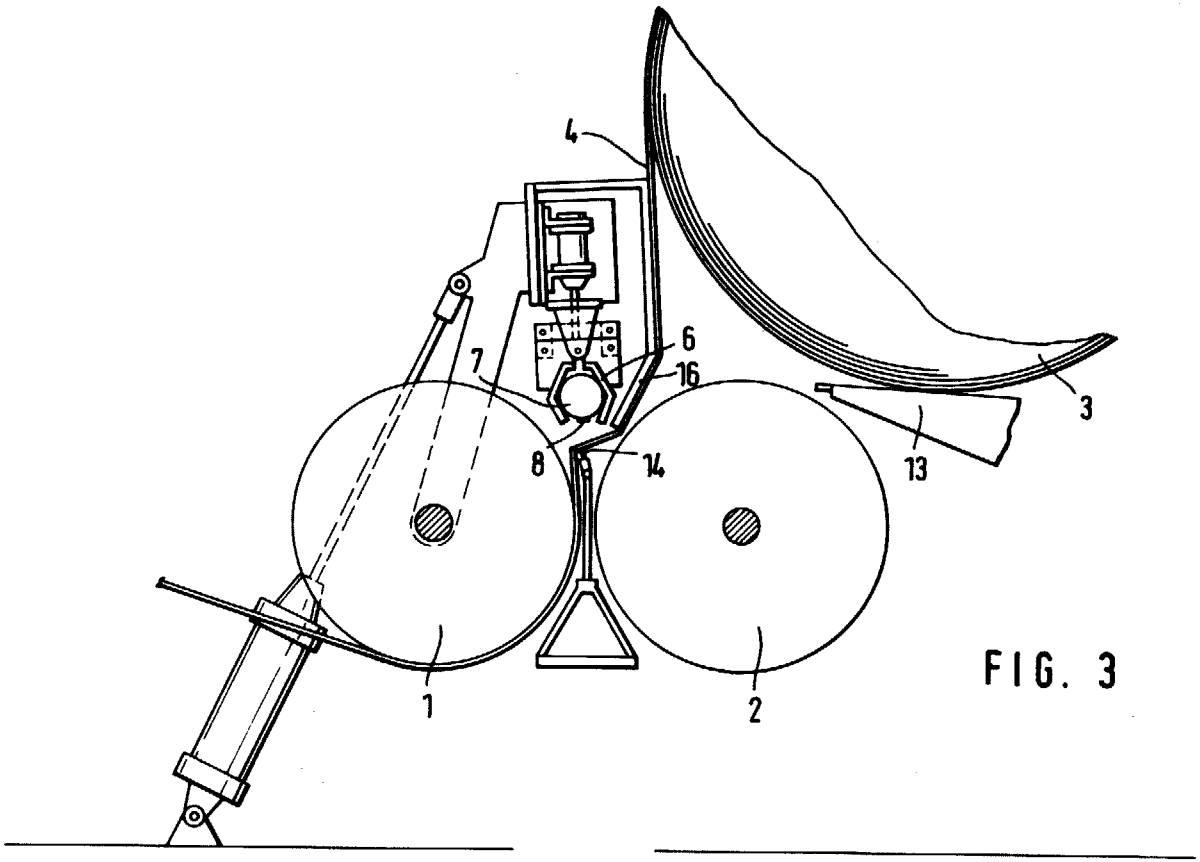
Figure 4:
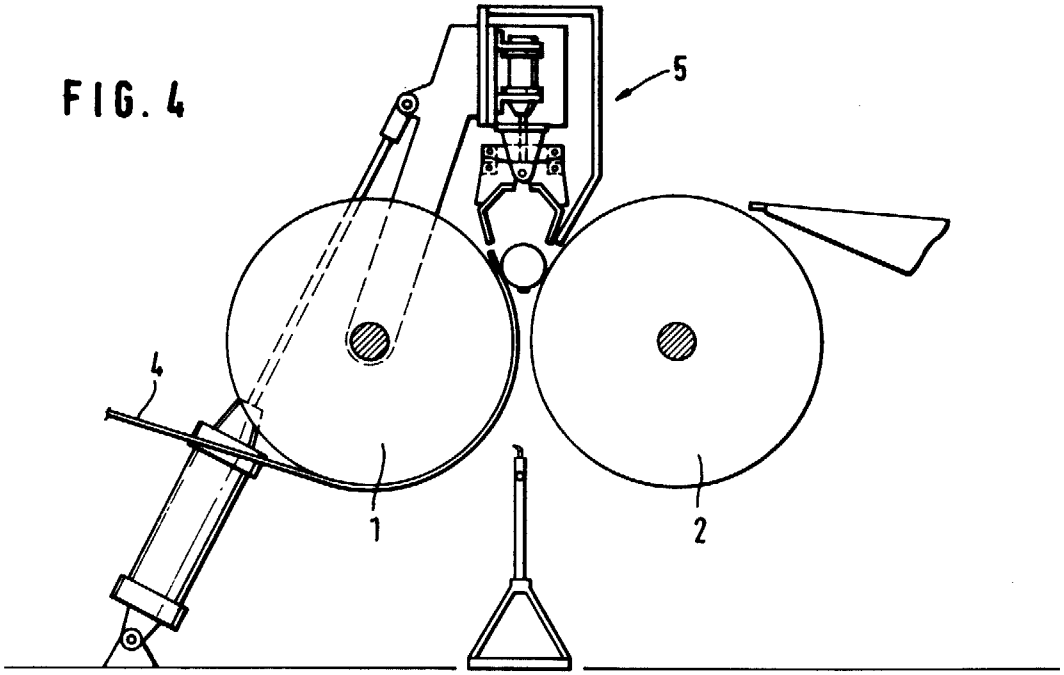

In the position according to FIG. 3, the web 4 is being severed by the cutting blade 14, and the web roll 3 rolls over the table 13. The core tube 7 is already in the transfer position, with the adhesive means, such as adhesive tape 8, daubs of glue, etc., directed downwardly. After the web 4 has been severed, the jaws of the clamping means 6 are actuated to introduce the core tube 7 accurately positioned into the wedge formed between the support rolls 1 and 2. The core tube 7 is then ready to be wound.

When the forward end 16 of the bar 10 is inwardly bent or angled, effective guidance of the web 4 during the core-tube change is secured, as shown particularly in FIGS. 2 and 3, and the front edge of the angled end 16 of the ejector bar 10 might then also serve as abutment surface in the severing operation.

In place of a bar 10, a roll for ejection of the

It will be appreciated that the instant specification and claims are set forth by way of illustration and not of limitation, and that various changes and modifications may be made without departing from the spirit and scope of the present invention.

What is claimed is:

1. In an apparatus for insertion of an accurately positioned second core tube provided along a generatrix with means for adhering the head end of a web into the wedge formed by two rotatable support rolls of a winding machine, and for ejection of a first tube supported by said support rolls and wound with said web, the improvement which comprises a pivoted lever arm (a) mounting a clamping means holding the new second core tube to be substituted for the first core tube about which said web is being wound, and (b) mounting an ejector bar having a forward end, means for pivoting said lever arm so that said forward end contacts and then ejects said first tube and web thereon from said wedge while displacing the clamping means from a first inoperative position to a second position adjacent said wedge, means for cutting the web when said first tube has been ejected, and means for opening said clamping means to release said second tube into said wedge whereupon the second tube is rotated by the support rolls and the adhering means on the second tube secures the web to the second tube for winding of said web thereon.

* * * * *